US010336408B1

(12) United States Patent
Jankowski

(10) Patent No.: US 10,336,408 B1
(45) Date of Patent: Jul. 2, 2019

(54) METHOD AND DEVICE FOR LOCKING ROPE WINCH

(71) Applicant: Jacek Jankowski, Warsaw (PL)

(72) Inventor: Jacek Jankowski, Warsaw (PL)

( * ) Notice: Subject to any disclaimer, the term of this patent is extended or adjusted under 35 U.S.C. 154(b) by 0 days.

(21) Appl. No.: 16/039,297

(22) Filed: Jul. 18, 2018

(51) Int. Cl.

| | |
|---|---|
| ***B63B 23/48*** | (2006.01) |
| *B63B 23/02* | (2006.01) |
| *B66D 1/54* | (2006.01) |
| *B66D 1/40* | (2006.01) |
| *B63B 35/40* | (2006.01) |

(52) U.S. Cl.
CPC ..... *B63B 23/48* (2013.01); *B63B 23/02* (2013.01); *B63B 35/40* (2013.01); *B66D 1/40* (2013.01); *B66D 1/54* (2013.01)

(58) Field of Classification Search
CPC ... B66D 5/12; B66D 5/14; B66D 5/18; B66D 5/22; B66D 5/32; B66D 5/34; B63B 23/48
See application file for complete search history.

(56) References Cited

U.S. PATENT DOCUMENTS

| | | | | |
|---|---|---|---|---|
| 4,280,605 | A * | 7/1981 | Papadopoulos | F16D 59/00 188/72.7 |
| 4,390,161 | A * | 6/1983 | Nelson | B66D 5/14 188/134 |
| 5,101,939 | A * | 4/1992 | Sheridan | B66D 5/14 188/171 |
| 5,944,150 | A * | 8/1999 | Hikari | B66D 5/14 188/156 |
| 6,431,482 | B1 * | 8/2002 | Ikuta | A01K 89/0179 242/297 |
| 7,226,038 | B1 * | 6/2007 | Wickstrom | B66D 1/54 254/276 |
| 2006/0150883 | A1 * | 7/2006 | Gordon | B63B 21/04 114/230.23 |
| 2014/0262693 | A1 * | 9/2014 | de Lore | B65G 23/44 198/813 |
| 2018/0237277 | A1 * | 8/2018 | Key | B66D 5/34 |

* cited by examiner

*Primary Examiner* — Emmanuel M Marcelo
(74) *Attorney, Agent, or Firm* — Neifeld IP Law, PC

(57) ABSTRACT

A method for locking the rope winch which is characterized by the fact that the locking bolt is inserted when the rope drum of the rope winch is stopped, first, through one of two holes in the first lug, then through one of the arched cuttings on the wheel of the rope drum of the rope winch, and finally through one of two holes in the second lug, Then the locking bolt is secured in position with a nut.

4 Claims, 1 Drawing Sheet

METHOD AND DEVICE FOR LOCKING ROPE WINCH

BACKGROUND OF THE INVENTION

Field of the Invention

The subject of the invention is the method and device for locking rope winch.

INDUSTRIAL APPLICABILITY

This invention may, in particular, serve for operation of rope winches in lifeboat launching systems mounted on ships and offshore platforms.

Background Art

There are a number of lifeboat launching systems for ships and offshore platforms, using rope winches allowing a lifeboat to descend automatically by unwinding the rope on a drum after the rope winch has been unlocked. On offshore platform systems, a lifeboat usually descends vertically into the water; on ships, it usually is moved outside the ship's board by a davit, and then it is vertically lowered into the water, along its side.

SUMMARY OF THE INVENTION

Technical Problem

Such solutions, however, do not allow to examine any potential failure of the rope winch until it is unlocked or until a lifeboat is lowered into the water.

Solution to Problem

The invention has a specific advantage in that it allows to engage the rope winch lock while a lifeboat is being pulled up, and, if there is any rope winch failure, such failure may be examined and repaired without any need to secure a lifeboat or lower it into the water.

Advantageous Effects of Invention

The invention also increases safety of any tests of the lifeboat launching systems for ships and offshore platforms using rope winches, namely, it allows to test moving a lifeboat from its original position to a position indicated by a rope winch drum lock.

DESCRIPTION OF THE DRAWINGS

The device for locking rope winch has been shown in the following figures.

DETAILED DESCRIPTION OF THE INVENTION

Figure 1:
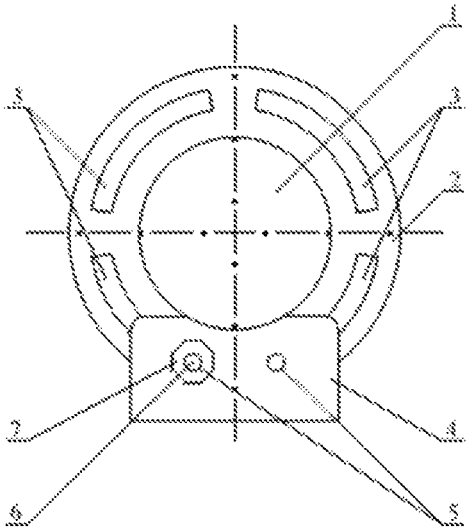
FIG. 1. is a transverse section of the device for locking rope winch, particularly for launching lifeboats, with arched cuttings 3 visible on the wheel 2 and with locking bolt 6 secured with a nut 7.
Figure 2:
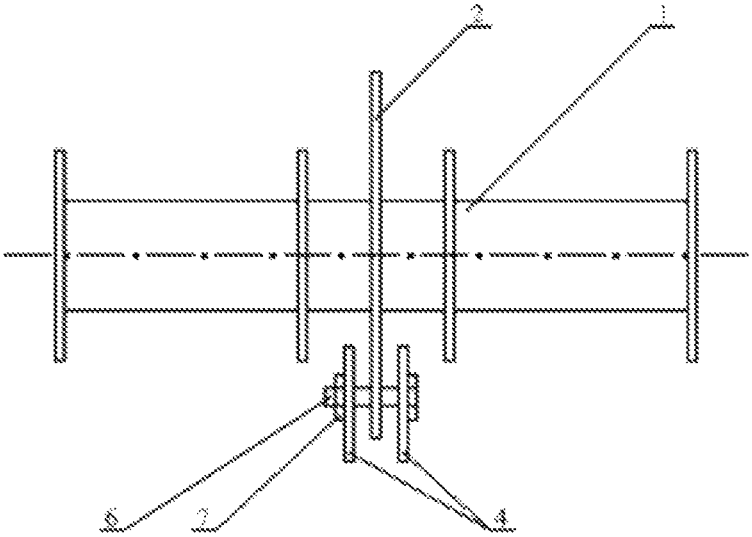
FIG. 2 is the longitudinal section of device for locking rope winch, particularly for launching lifeboats, with parallel lugs 4 and the wheel 2 in between them.

The device for locking rope winch presented in FIG. 1 and FIG. 2 consists of a wheel 2 controlling the rope drum 1 of the lifeboat rope winch, with arched cuttings 3, and, on both its sides, identical separate fixed lugs 4 with two holes 5 in each, and a locking bolt 6 with a nut 7.

The arched cuttings 3 in the wheel 2 controlling the rope drum 1 of the lifeboat rope winch are identical in length and are positioned in equal distance from each other on the arc of the circle which has its centre in the rotation axis of the rope drum 1 of the lifeboat rope winch.

Each separate fixed lug 4 contains two identical holes 5 positioned on the arc of the circle which has its centre in the rotation axis of the rope drum 1 of the lifeboat rope winch.

The length of the arc with its centre in the rotation axis of the rope drum 1 of the lifeboat rope winch, measured between two holes 5 of each lug 4, is more than the length of the arc between arched cuttings 3 and less than the length of the arc of each arched cutting 3. As the rope drum 1 of the rope winch rotates, at least one of the holes 5 in each lug 4 aligns with one of the arched cuttings 3 on the wheel 2 of the rope drum 1 of the rope winch, subsequently allowing to insert the locking bolt 6 if the rope drum 1 of the rope winch has been previously stopped.

The locking bolt 6 is inserted when the rope drum 1 of the rope winch is stopped, first, through one of two holes 5 in the first lug 4, then through one of the arched cuttings 3 on the wheel 2 of the rope drum 1 of the rope winch, and finally through one of two holes 5 in the second lug 4, then it is secured in position with a nut 7 which locks rotational movement of the rope drum 1 of the rope winch.

As the length of the arc with its centre in the rotation axis of the rope drum 1 of the lifeboat rope winch, measured between two holes 5 of each lug 4, is more than the length of the arc between arched cuttings 3 and less than the length of the arc of each arched cutting 3, the use of the locking bolt 6 results in blocking the rotary movement of the rope drum 1 of the rope winch with a delay.

REFERENCE SIGNS LIST

1 rope drum
2 wheel
3 cutting
4 lug
5 hole
6 locking bolt
7 nut

The invention claimed is:

1. A method for locking a rope winch, characterised in that a locking bolt (6) is inserted when a rope drum (1) of the rope winch is stopped;

first, said inserting is performed through one of two holes (5) in a first lug (4);

then said inserting is performed through one of multiple arched cuttings (3) on a wheel (2) of the rope drum (1) of the rope winch; and finally said inserting is performed through one of two holes (5) in a second lug (4), then the locking bolt (6) is secured in position with a nut (7).

2. The method of claim 1, characterised in that while the rope drum (1) of the rope winch rotates, at least one of two holes (5) in each lug (4) aligns with one of the multiple arched cuttings (3) on the wheel (2) of the rope drum (1) of the rope winch.

3. A device for locking a rope winch, particularly for launching lifeboats, equipped with a rope drum (1) with a wheel and lugs, characterised in that there are arched cuttings of identical length (3) in the wheel (2) which are positioned in equal distance from each other on an arc of a circle which has its centre in a rotation axis of the rope drum (1) of the rope winch and each lug (4) has two identical holes (5) positioned on the arc of the circle which has its centre in the rotation axis of the rope drum (1).

4. The device of claim 3, characterised in that the length of the arc with its centre in the rotation axis of the rope drum (1) of the rope winch, measured between two holes (5) of each tug (4), is more than the length of the arc between said arched cuttings (3) and less than the length of the arc of each arched cutting (3).

* * * * *